US006359018B1

(12) United States Patent
O'Rear et al.

(10) Patent No.: US 6,359,018 B1
(45) Date of Patent: Mar. 19, 2002

(54) PROCESS FOR UPFLOW FIXED-BED HYDROPROCESSING OF FISCHER-TROPSCH WAX

(75) Inventors: Dennis J. O'Rear, Petaluma; Krishniah Parimi, Concord; Richard O. Moore, Jr., San Rafael, all of CA (US)

(73) Assignee: Chevron U.S.A. Inc, San Ramon, CA (US)

( * ) Notice: Subject to any disclaimer, the term of this patent is extended or adjusted under 35 U.S.C. 154(b) by 0 days.

(21) Appl. No.: 09/698,392

(22) Filed: Oct. 27, 2000

(51) Int. Cl.[7] ..... C07C 27/00; C07C 2/00; C07C 5/13; C07C 4/02; C10G 45/00

(52) U.S. Cl. ..... 518/700; 585/734; 585/700; 585/752; 208/57; 208/133; 208/161; 518/706

(58) Field of Search ..... 518/700, 706; 585/734, 752, 700; 208/133, 57, 161

(56) References Cited

U.S. PATENT DOCUMENTS

| | | | | |
|---|---|---|---|---|
| 4,376,037 | A | 3/1983 | Dahlberg et al. | 208/109 |
| 4,389,301 | A | 6/1983 | Dahlberg et al. | 208/59 |
| 4,605,678 | A | 8/1986 | Brennan et al. | 518/700 |
| 5,407,644 | A | 4/1995 | Rytter et al. | 422/147 |
| 5,770,629 | A | 6/1998 | Degeorge et al. | 518/700 |
| 5,811,469 | A | 9/1998 | Leviness et al. | 518/700 |
| 5,900,159 | A | 5/1999 | Engel et al. | 210/788 |

*Primary Examiner*—Sreeni Padmanabhan
*Assistant Examiner*—J. Parsa
(74) *Attorney, Agent, or Firm*—Alan W. Klaassen

(57) ABSTRACT

An integrated process for producing a liquid hydrocarbon stream from Fischer-Tropsch hydrocarbon product without having to remove particulate contaminants such as catalyst fines from hot Fischer-Tropsch wax is disclosed. The process involves performing Fischer-Tropsch synthesis, preferably under conditions which favor formation of wax and heavy products (i.e., using a catalyst with high chain growth probabilities), and obtaining a waxy heavy fraction including particulate contaminants. The fraction is subjected to hydroprocessing conditions, preferably upflow hydroprocessing conditions, using a catalyst bed which, through judicious selection of hydroprocessing catalysts and/or flow conditions, permits passage of the particulate contaminants. The particulates are then removed from the upgraded liquid product, for example by filtration, distillation and/or centrifugation. Removal of the particulate contaminants from the upgraded liquid hydrocarbon products is significantly easier than removing the particulates from the unprocessed waxy heavy products.

18 Claims, No Drawings

PROCESS FOR UPFLOW FIXED-BED HYDROPROCESSING OF FISCHER-TROPSCH WAX

FIELD OF THE INVENTION

This invention is generally in the area of the Fischer-Tropsch synthesis, particularly in the area of hydroprocessing of Fischer-Tropsch waxy products.

BACKGROUND OF THE INVENTION

The majority of fuel today is derived from crude oil. Crude oil is in limited supply, and fuel derived from crude oil tends to include nitrogen-containing compounds and sulfur-containing compounds, which are believed to cause environmental problems such as acid rain.

Natural gas is an abundant source of hydrocarbon fuels, lubricating oils, all chemicals and chemical feedstocks. One method of using natural gas in this way involves converting the gas to synthesis gas ("syngas"). For example, in a Fischer-Tropsch process, the syngas produced from a natural gas source is converted to a product stream that includes a broad spectrum of products, ranging from methane to wax. The resulting wax can be hydroprocessed to form lower molecular weight products in the distillate fuel and lubricating oil range. The hydroprocessing is carried out by passing the wax downwardly through one or more catalyst beds, with a cocurrent hydrogen enriched gas stream. The liquid hydrocarbon feed "trickles" down through the catalyst beds and exits the reactor bottom after the desired upgrading is achieved (i.e., a downflow reactor).

In some cases, the feeds prepared for hydroprocessing contain particulate contaminants from upstream processing, such as catalyst fines, catalyst support and the like, upstream equipment (rust and scale), and/or from the source (e.g., crude oil, coal ash) in a wide range of sizes and concentrations. These particulates can cause serious operating difficulties when introduced with the feed into a fixed-bed, trickle-flow hydroprocessing reactor. The most frequent difficulty is pressure drop build-up and eventual plugging of the flow-paths through the catalyst beds as the catalyst pellets filter out the feed particulates. Such build-up can cause significant economic loss in lost production and replacement catalyst costs.

Fischer-Tropsch wax and heavy products, especially those from slurry and fluid bed processes, may contain particulate contaminants such as catalyst fines, which are not adequately removed by filters provided for that purpose. Removing these particulates prior to hydroprocessing is complicated by the viscosity and temperature of the wax stream leaving the Fischer-Tropsch reactor. It would be advantageous to provide an efficient process for hydroprocessing the wax and heavy products from Fischer-Tropsch syntheses that overcomes the need to have nearly complete removal of the particulate contaminants from the heavy products prior to hydroprocessing. The present invention provides such a process.

SUMMARY OF THE INVENTION

The invention provides the described advantages as well as many others obvious to the ordinary skilled artisan. An integrated process for hydroprocessing a Fischer-Tropsch product containing particulate contaminates such as catalyst fines, is disclosed. The process involves performing Fischer-Tropsch synthesis and obtaining a hydrocarbon fraction which contains particulate contaminants. The fraction is subjected to hydroprocessing conditions, preferably upflow hydroprocessing conditions, using a catalyst bed which, through judicious selection of hydroprocessing catalysts and/or flow conditions, permits passage of the particulate contaminants through the bed. Particulate contaminants remaining in the liquid products recovered from hydroprocessing are then removed from the hydroprocessed liquid product, for example by filtration, centrifugation and/or distillation, which is significantly easier than filtering the particulate contaminants from the Fischer-Tropsch synthesis product.

The present method is effective for removing contaminants from any Fischer-Tropsch product stream, regardless of boiling range. In one embodiment, the invention is directed to producing and hydroprocessing heavy Fischer-Tropsch products rich in linear hydrocarbons with a chain length above $C_{20}$. In producing a desirable distillate fuel composition, a Fischer-Tropsch product is hydroprocessed to remove oxygenates, to form isoparaffins through hydroisomerization of the normal paraffins in the heavy Fischer-Tropsch products, and/or to crack the heavy Fischer-Tropsch products to reduce their boiling point range. Hydroisomerization improves the cold properties (e.g., pour point, cloud point, cold filter plugging point (CFPP)) of the products. The hydroprocessing steps may include hydrodewaxing, hydrocracking, hydroisomerization, hydrotreating and other processes. Standard known hydroprocessing catalysts are employed in catalytically effective amounts.

According to the invention, a process is provided for upgrading a Fischer-Tropsch product, wherein the process comprises subjecting syngas to Fischer-Tropsch synthesis conditions, recovering a hydrocarbon fraction from the Fischer-Tropsch synthesis, wherein the fraction further comprises particulate contaminants, subjecting the fraction to hydroprocessing conditions and forming an upgraded product stream which includes at least a portion of the particulate contaminants, and removing at least a portion of the particulate contaminants from the upgraded product stream.

DETAILED DESCRIPTION

An integrated process for producing a liquid hydrocarbon stream from a Fischer-Tropsch process is disclosed. The integrated process involves performing Fischer-Tropsch synthesis, preferably under conditions which favor formation of wax and heavy products (i.e., using a catalyst with high chain growth probabilities), and obtaining hydrocarbon fraction including particulate contaminants such as catalyst fines. Fischer-Tropsch processes that have slurry or fluidized bed reactors are particularly subject to entrained catalyst particulates. The fraction is subjected to hydroprocessing conditions, preferably upflow hydroprocessing conditions, using a catalyst bed which, through judicious selection of hydroprocessing catalysts and/or flow conditions, permits passage of the particulate contaminants. The resulting products are liquid hydrocarbon products which still include the particulate contaminants. At least a portion of the particulate contaminants are then removed from the liquid product, for example by filtration, centrifugation and/or distillation, which is significantly easier than filtering the particulate contaminants from the Fischer Tropsch products.

The catalysts, reactants, reaction conditions and methods for preparing and isolating desired compounds are discussed in more detail below.

In addition to methane, natural gas includes some heavier hydrocarbons (mostly $C_{2-5}$ paraffins) and other impurities, e.g., mercaptans and other sulfur-containing compounds, carbon dioxide, nitrogen, helium, water and non-hydrocarbon acid gases. The methane and/or ethane can be isolated and used to generate syngas. Various other impurities can be readily separated. Inert impurities such as nitrogen and helium can be tolerated. The methane in the natural gas can be isolated, for example in a demethanizer, and then de-sulfurized and sent to a syngas generator.

Methane (and/or ethane and heavier hydrocarbons) can be desulfurized and sent through a conventional syngas generator to provide synthesis gas. Typically, synthesis gas contains hydrogen and carbon monoxide, and may include minor amounts of carbon dioxide and/or water.

The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guard beds are preferred for removing sulfur impurities. Means for removing other contaminants are well known to those of skill in the art.

The Fischer-Tropsch products tend to include linear hydrocarbons with a chain length above $C_{20}$. For use in distillate fuel compositions, they are preferably processed to include a suitable quantity of isoparaffins to retain good burning characteristics (e.g., cetane number) while improving cold properties (e.g., pour point, cloud point, cold filter plugging point (CFPP)). In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300 to 700° F. (149 to 371° C.) preferably about from 400° to 550° F. (204° to 288° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products may range from $C_1$ to $C_{200+}$ with a majority in the $C_5$–$C_{100}$ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of L cobalt and one or more of Re, Ru, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

Any C5+ hydrocarbon stream derived from a FT process may be suitably treated using the present process. Typical hydrocarbon streams include a $C_5$-700° F. stream and a waxy stream boiling above about 550° F., depending on the FT reactor configuration. The preferred FT product is recovered directly from a FT reactor, without fractionation. If a fractionation step is included after the FT reactor, the preferred product is a bottoms product from the fractionator. The particulate content of the wax will generally be small, usually less than 500 ppm on a mass basis, and preferably less than 200 ppm on a mass basis. The particulates will generally be less than 500 $\mu$m in diameter (i.e. passes through a 500 $\mu$m screen), and often less than 250 $\mu$m in diameter.

The product(s) from the Fischer-Tropsch synthesis is subjected to hydroprocessing conditions, which may include hydrodewaxing, hydrocracking, hydroisomerization, hydrotreating and other processes which lower the chain length and/or increase the amount of iso-paraffins in the product. This product can optionally be combined with hydrocarbons from other sources such as gas oils, lubricating oil stocks, high pour point polyalphaolefins, foots oils, synthetic waxes such as normal alpha-olefin waxes, slack waxes, de-oiled waxes and microcrystalline waxes. Foots oil is prepared by separating oil from the wax, where the isolated oil is referred to as foots oil. Preferably, the boiling point of the feedstocks is above that of distillate fuel and below about 1200° F.

The hydroprocessing conditions preferably produce a product stream rich in $C_5$–$C_{20}$ hydrocarbons, preferably containing a suitable amount of isoparaffins to improve the cold properties (e.g., pour point, cloud point, cold filter plugging point (CFPP)) of the products. Conditions which tend to form a relatively large amount of $C_{1-4}$ products are not preferred. Conditions which form $C_{20}$+ products with sufficient isoparaffins to lower the melting point of the wax and/or heavy fraction such that the particulates are more easily removed via filtration can also be used.

The hydroprocessing reactions are preferably performed using upflow reactors, where the Fischer-Tropsch product flows upwards against gravity through a catalyst bed including appropriate catalysts and reactants, for example hydrogen gas. The catalyst particles must be of an appropriate size that catalyst fines from the Fischer-Tropsch synthesis do not plug up the catalyst beds, and that diffusion limitations and reactor pressure drops are minimized. The particles will generally have a cross sectional diameter between about 1/64 inch and about ½ inch, and preferably between about 1/32 inch and about ¼ inch, ie. the particles will be of a size to be retained on a 1/64 inch, and preferably on a 1/32 inch screen and will pass through a ½ inch, and preferably through a ¼ inch screen. The catalyst particles may have any shape known to be useful for catalytic materials, including spheres, cylinders (i.e. extrudates), fluted cylinders, prills, granules and the like. Preferred catalyst particles have a cross sectional diameter of at least 1/20 inch (i.e. the particles will be of a size to be retained on a 1/20 inch screen) and have a spherical or cylindrical shape. The superficial velocity of the liquid flowing upwards through the hydroprocessing reactor (s) is maintain at a rate greater than the settling velocity of the particulate contaminants present in the upward flowing liquid, but less than the fluidization velocity of the catalyst particles in the reactor(s). Such values of velocity are based on the size, shape and density of the particulate contaminants and of the catalyst particles, and therefor depends on the specific processing configuration employed. Methods for calculating such velocities are well within the capability of one skilled in the art.

As used herein, the term "hydrotreating" is given its conventional meaning and describes processes that are well known to those skilled in the art. Hydrotreating refers to a catalytic process, usually carried out in the presence of free hydrogen, in which the primary purpose is the desulfurization and/or denitrification of the feedstock. In addition, oxygen is removed from oxygen-containing hydrocarbons (e.g., alcohols, acids, etc.). The sulfur is generally converted to hydrogen sulfide, the nitrogen is generally converted to ammonia, and the oxygen is converted to water, and these can be removed from the product stream using means well known to those of skill in the art. Although sulfur impurities are typically not present in Fischer-Tropsch products, they can be introduced when the products are contacted with pre-sulfided catalysts.

Generally, in hydrotreating operations, cracking of the hydrocarbon molecules, i.e., breaking the larger hydrocarbon molecules into smaller hydrocarbon molecules, is minimized and unsaturated hydrocarbons are either fully or partially hydrogenated.

Catalysts used in carrying out hydrotreating operations are well known in the art. See, for example, U.S. Pat. Nos. 4,347,121 and 4,810,357 for general descriptions of hydrotreating and typical catalysts used hydrotreating processes.

Suitable catalysts include noble metals from Group VIIIA, such as platinum or palladium on an alumina or siliceous matrix, and Group VIIIA and Group VIB metals, such as nickel, cobalt, molybdenum, tungsten or mixtures thereof on an alumina or siliceous matrix. U.S. Pat. No. 3,852,207 describes a suitable noble metal catalyst and reaction conditions. Other suitable catalysts are described, for example, in U.S. Pat. Nos. 4,157,294 and 3,904,513. Non-noble metals (such as nickel-molybdenum) are usually present in the final catalyst composition as oxides, or possibly as sulfides, when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts include in excess of 0.01 weight percent metal, preferably between 0.1 and 1.0 weight percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation. Although these components can be combined with the catalyst matrix as the sulfides, that may not be preferred, as the sulfur compounds may interfere with some molecular redistribution catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (*J. Am. Chem. Soc.* 1992, 114, 10834–10843), MCM-41 (U.S. Pat. Nos. 5,246,689, 5,198,203 and 5,334,368), and MCM-48 (Kresge et al., *Nature* 359 (1992) 710). The contents of each of the patents and publications referred to above are hereby incorporated by reference in its entirety.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrotreating conditions vary over a wide range. In general, the overall LHSV is about 0.25 to 20, preferably about 0.5 to 10. The hydrogen partial pressure is greater than 200 psia, preferably ranging from about 500 psia to about 2000 psia. Hydrogen recirculation rates are typically greater than 50 SCF/Bbl, and are preferably between 300 and 6000 SCF/Bbl. Temperatures range from about 300° F. to about 750° F., preferably ranging from 400° F. to 750° F.

Typical hydroisomerization conditions are well known in the literature and can vary widely. Isomerization processes are typically carried out at a temperature between 200° F. and 800° F., preferably 400° F. to 750° F., with a liquid hourly space velocity between 0.1 and 5, preferably between 0.25 and 2.50. Hydrogen is employed such that the mole ratio of hydrogen to hydrocarbon is between 1:1 and 20:1. Catalysts useful for isomerization processes are generally bifunctional catalysts that include a dehydrogenation/hydrogenation component and an acidic component.

The hydroisomerization catalyst(s) can be prepared using well known methods, e.g., impregnation with an aqueous salt, incipient wetness technique, followed by drying at about 125–150° C. for 1–24 hours, calcination at about 300–500° C. for about 1–6 hours, reduction by treatment with a hydrogen or a hydrogen-containing gas, and, if desired, sulfiding by treatment with a sulfur-containing gas, e.g., $H_2S$ at elevated temperatures. The catalyst will then have about 0.01 to 10 wt % sulfur. The metals can be composited or added to the catalyst either serially, in any order, or by co-impregnation of two or more metals. Additional details regarding preferred components of the hydroisomerization catalysts are described below.

The dehydrogenation hydrogenation component is preferably one or more of a Group VIII noble metal such as platinum and/or palladium, a Group VIII non-noble metal such as nickel or cobalt or mixtures thereof, or a Group VI metal such as tungsten, molybdenum or mixtures thereof. The Group VIII non-noble metal is usually present in catalytically effective amounts, that is, ranging from 0.5 to 20 wt %. Preferably, a Group VI metal is incorporated into the catalyst, e.g., molybdenum, in amounts of about 1–20 wt %. The noble metal (such as platinum) catalysts include in excess of 0.01 percent metal, preferably between 0.1 and 1.0 percent metal.

Examples of suitable acid components include crystalline zeolites, catalyst supports such as halogenated alumina components or silica-alumina components, and amorphous metal oxides. Such paraffin isomerization catalysts are well known in the art. The acid component may be a catalyst support with which the catalytic metal or metals are composited. Preferably, the acidic component is a zeolite or a silica-alumina support, where the silica/alumina ratio (SAR) is less than 1 (wt./wt.).

Preferred supports include silica, alumina, silica-alumina, silica-alumina-phosphates, titania, zirconia, vanadia and other Group III, IV, V or VI oxides, as well as Y sieves, such as ultra stable Y sieves. Preferred supports include alumina and silica-alumina, more preferably silica-alumina where the silica concentration of the bulk support is less than about 50 wt %, preferably less than about 35 wt %, more preferably 15–30 wt %. When alumina is used as the support, small amounts of chlorine or fluorine may be incorporated into the support to provide the acid functionality.

A preferred supported catalyst has surface areas in the range of about 180–400 $m^2$ /gm, preferably 230–350 $m^2$ /gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., Cracking Catalysts, Catalysis; Volume VII, Ed. Paul H. Emmett, Reinhold Publishing Corporation, New York, 1960.

Hydrocracking refers to a catalytic process, usually carried out in the presence of free hydrogen, in which the cracking of the larger hydrocarbon molecules is a primary purpose of the operation. Desulfurization and/or denitrification of the feed stock usually will also occur.

Catalysts used in carrying out hydrocracking operations are well known in the art, and it should not be necessary to describe them in detail here. See, for example, U.S. Pat. Nos. 4,347,121 and 4,810,357 for general descriptions of hydrotreating, hydrocracking, and typical catalysts used in each process. The product from the hydrocracking can be subject to distillation and/or catalytic isomerization to provide various hydrocarbon products lube oils, diesel fuel, and the like and, preferably, to provide a product stream comprising normal and isoparaffins in the $C_{5-20}$ range.

During hydroprocessing, the Fischer-Tropsch product is upgraded through hydrotreating, hydroisomerization and/or hydrocracking to produce high yields of more desirable products. The upgraded product recovered from the hydroprocessing step contains particulates which were passed through the hydroprocessing reactor along with the reacting product stream. In the process of the invention, these particulates are removed from the upgraded product stream, using one or more of a variety of methods known in the art for removing particulate matter. For example, filter(s) placed in the upgraded product stream effectively removes the particulate matter to very low levels. In a preferred process, the upgraded product stream is cooled by at least 100° F. below the hydroprocessing temperature, and the upgraded product is passed through a package filter system, more preferably a disposable cartridge filter, in order to remove some or all of the particulates remaining in the upgraded product stream. The filtering temperature is selected for the particular filter system used in the process.

Alternatively, the particulates are removed during a distillation step for separating the upgraded product into component products of varying boiling ranges. Ideally, the particulates remain in the bottoms fraction recovered from distillation. This bottoms fraction may be discarded, if sufficiently small, or used for applications which are not affected by the particulates in the bottoms fraction. Alternatively, the bottoms fraction is passed through a filter system similar to that described for filtering the upgraded product. In the most preferred process, each of the liquid streams recovered from a distillation step is passed through filter(s) to remove the remaining particulates present therein.

Depending on the particular operation, other particulate separation methods, such as centrifugation, may be used, either alone or in combination with the other methods already described.

The invention has been described with respect to particularly preferred embodiments. Modifications obvious to the ordinary skilled artisan are intended to be included within the invention and claims.

What is claimed is:

1. A process for upgrading a Fischer Tropsch product, comprising:

a) subjecting syngas to Fischer-Tropsch synthesis conditions, b) recovering a hydrocarbon fraction from the Fischer-Tropsch synthesis, wherein the fraction further comprises residual Fischer-Tropsch catalyst fines, c) subjecting the fraction to upflow hydroprocessing conditions using a hydroprocessing catalyst bed, wherein the catalyst bed permits passage of the residual Fischer-Tropsch catalyst fines through the bed, to form an upgraded product stream, and d) removing at least a portion of the residual Fischer-Tropsch catalyst fines from the upgraded product stream of step c.

2. The process of claim 1, wherein the residual Fischer-Tropsch catalyst fines are removed via filtration.

3. The process of claim 1, wherein the residual Fischer-Tropsch catalyst fines are removed by distilling the upgraded product into component products and a bottoms fraction containing the residual Fischer-Tropsch catalyst fines.

4. The process of claim 1, wherein the residual Fischer-Tropsch catalyst fines are removed via centrifugation.

5. The process of claim 1, wherein the Fischer-Tropsch synthesis conditions comprise using catalysts with high chain growth probabilities.

6. The process of claim 1, wherein the Fischer-Tropsch synthesis conditions comprise conditions which favor formation of wax and heavy products.

7. The process of claim 1, wherein the Fischer-Tropsch synthesis conditions comprise a slurry bed reactor.

8. The process of claim 1, wherein the hydroprocessing catalysts are selected from the group consisting of hydrotreatment, hydrocracking and hydroisomerization catalysts.

9. The process of claim 1 wherein the hydroprocessing catalysts have a cross sectional diameter of at least 1/20 inch and a spherical or cylindrical shape.

10. In a process for converting syngas to hydrocarbon products, wherein the overall process includes a Fischer-Tropsch synthesis step and at least one subsequent hydroprocessing step, and wherein the process forms a Fischer-Tropsch hydrocarbon fraction which contains residual Fischer-Tropsch catalyst fines, the improvement which comprises:

a) processing the Fischer-Tropsch hydrocarbon fraction in an upflow reactor using a hydroprocessing catalyst bed, wherein the catalyst bed permits passage of the residual Fischer-Tropsch catalyst fines through the bed, to create an upgraded product, and b) removing the residual Fischer-Tropsch catalyst fines from the upgraded product.

11. The process of claim 10 wherein the residual Fischer-Tropsch catalyst fines are removed via filtration.

12. The process of claim 10 wherein the residual Fischer-Tropsch catalyst fines are removed by distilling the upgraded product into component products and a bottoms fraction containing the residual Fischer-Tropsch catalyst fines.

13. The process of claim 10, wherein the residual Fischer-Tropsch catalyst fines are removed via centrifugation.

14. The process of claim 10 wherein the hydroprocessing catalysts have a cross sectional diameter of at least 1/20 inch and having a spherical or cylindrical shape.

15. A process for upgrading a Fischer-Tropsch product, the process comprising:

a) subjecting syngas to Fischer-Tropsch synthesis conditions in a slurry bed reactor to form a hydrocarbon product stream;

b) recovering a hydrocarbon fraction from the slurry bed reactor, wherein the fraction comprises residual Fischer-Tropsch catalyst fines;

c) subjecting the fraction to upflow hydroprocessing conditions using a hydroprocessing catalyst bed, wherein the hydroprocessing catalysts have a cross sectional diameter of at least 1/20 inch and a spherical or cylindrical shape, to form an upgraded product stream;

d) removing the residual Fischer-Tropsch catalyst fines from the upgraded product stream.

16. The process of claim 15, wherein the residual Fischer-Tropsch catalyst fines are removed by distilling the upgraded product into component products and a bottoms fraction containing the residual Fischer-Tropsch catalyst fines.

17. The process of claim 15, wherein the hydroprocessing catalysts are selected from the group consisting of hydrotreatment, hydrocracking, and hydroisomerization catalysts.

18. The process of claim 15, wherein recovering the hydrocarbon fraction from the slurry bed reactor comprises filtering the hydrocarbon product stream to provide the hydrocarbon fraction comprising residual Fischer-Tropsch catalyst fines.

* * * * *